United States Patent [19]

Fernandes

[11] Patent Number: 4,458,944

[45] Date of Patent: Jul. 10, 1984

[54] FORMATION OF IN SITU OIL SHALE RETORT IN PLURAL STEPS

[75] Inventor: Robert J. Fernandes, Bakersfield, Calif.

[73] Assignee: Occidental Oil Shale, Inc., Grand Junction, Colo.

[21] Appl. No.: 278,893

[22] Filed: Jun. 29, 1981

[51] Int. Cl.[3] ..... E21C 41/10

[52] U.S. Cl. ..... 299/2; 299/13

[58] Field of Search ..... 299/2, 13; 102/311, 102/312; 166/259, 251

[56] References Cited

U.S. PATENT DOCUMENTS

| | | | |
|---|---|---|---|
| 2,536,869 | 6/1951 | Bucky | 299/13 |
| 3,951,456 | 4/1976 | Ridley | 299/2 |
| 3,980,339 | 9/1976 | Heald et al. | 299/2 |
| 4,017,119 | 4/1977 | Lewis | 299/2 |
| 4,153,300 | 5/1979 | Kvapil et al. | 299/2 |
| 4,194,788 | 3/1980 | Miller | 299/2 |
| 4,246,965 | 1/1981 | Cha | 166/251 |
| 4,290,649 | 9/1981 | Ricketts | 299/13 X |

*Primary Examiner*—Ernest R. Purser

*Attorney, Agent, or Firm*—Christie, Parker & Hale

[57] ABSTRACT

A subterranean formation containing oil shale is prepared for in situ retorting by forming a fragmented permeable mass of formation particles containing oil shale in an in situ retort site. The retort is formed by excavating a lower level drift adjacent to a lower portion of the retort site and excavating an undercut within the retort site below a zone of unfragmented formation remaining within the retort site above the undercut. The bottom of the undercut slopes downwardly toward the lower level drift which opens into one side of the undercut, the slope being generally at the natural angle of slide of oil shale particles. The remaining zone of unfragmented formation is blasted downwardly toward the undercut in a series of lifts in sequence progressing upwardly in the retort site. The mass of formation particles formed during such blasting in lifts tends to slope downwardly toward the side of the retort adjacent the lower level drift. Formation particles are withdrawn from the fragmented mass between lifts through the lower level drift to provide void space toward which each lift is blasted. Such withdrawal of formation particles can create relatively higher permeability in the fragmented mass along the side above the lower level drift and relatively lower permeability in the fragmented mass along the opposite side of the retort. During retorting operations, to compensate for such permeability gradient, oxygen supplying gas is introduced into the upper low permeability region of the fragmented mass, and off gas is withdrawn through the lower level drift at the lower high permeability region for producing a generally diagonal gas flow pattern through the retort.

35 Claims, 2 Drawing Figures

FORMATION OF IN SITU OIL SHALE RETORT IN PLURAL STEPS

BACKGROUND

1. Field of the Invention

This invention relates to in situ recovery of shale oil, and more particularly to a mining system for excavation and explosive expansion of oil shale formation in preparation for forming an in situ oil shale retort.

2. Description of the Prior Art

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,192,554; which are incorporated herein by this reference. These patents describe in situ recovery of liquid and gaseous hydrocarbon materials from a subterranean formation containing oil shale, wherein such formation is explosively expanded for forming a fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted shale oil. One method of supplying hot retorting gases used for converting kerogen contained in oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

Techniques used for forming a fragmented mass can affect the uniformity of particle size or permeability of the fragmented mass. A fragmented mass having reasonably uniform permeability in horizontal planes across the fragmented mass can avoid bypassing portions of the fragmented mass by retorting gas, which can otherwise occur if there is gas channeling through the fragmented mass owing to non-uniform permeability. A fragmented mass having non-uniform permeability can be processed if techniques are provided for avoiding gas flow bypassing regions of low permeability in the fragmented mass.

In situ oil shale retorts have been devised with a drift communicating with the fragmented mass through a side boundary near the bottom of the retort. With such an arrangement, an appreciable quantity of oil shale in the fragmented mass can remain unretorted at the end of retorting operations. This problem can arise from several factors. Gas introduced into the fragmented mass tends to flow more or less directly toward the gas outlet. When the gas outlet is in the form of a drift opening through a side boundary of the retort, gas flow tends to concentrate toward that side of the retort, and an appreciable volume of oil shale adjacent the opposite side boundary near the bottom of the retort can be bypassed. Such oil shape bypassed by gas flow can remain unretorted. Further, in some techniques for forming the fragmented mass, some particles can flow or be driven into a drift communicating with the retort, resulting in a higher void fraction in a region above the drift than in other parts of the fragmented mass. Such a high void fraction can permit preferential gas flow or channelling and thereby bypass parts of the fragmented mass with lower void fraction.

Consequently, there is a need to develop techniques for avoiding yield losses in a retort having a lower level drift that communicates with the fragmented mass through a side boundary near the bottom of the retort. Such a retort can provide significant savings of mining costs since an economical two-level mining system can be used with an upper working level excavated adjacent to the upper boundary of the retort and a lower working level, or lower level drift at the lower boundary of the retort. Such a mining system can be more economical than a system having multiple intermediate level voids. For instance, U.S. Pat. No. 4,043,597 and 4,043,598 disclose methods for forming a fragmented mass in a horizontal free face system with intermediate level voids. The mining and construction costs involved in preparing a retort for explosive expansion can be reduced by eliminating excavation of multiple voids and corresponding retort level access drifts at intermediate levels of a retort site.

The present invention facilitates use of a two-level, horizontal free face mining system in which a fragmented mass can be formed without excavating multiple void spaces and corresponding retort level access drifts at different intermediate levels within a retort site. In addition, the present invention provides techniques for avoiding gas channeling in a fragmented mass having a non-uniform permeability distribution. The invention also provides techniques for significantly reducing gas channeling through a fragmented mass having a lower level drift communicating with a lower side boundary of the fragmented mass.

SUMMARY OF THE INVENTION

According to one embodiment of this invention, a lower level drift is excavated adjacent a lower portion of an in situ oil shale retort site. An undercut is excavated in a lower portion of the retort site adjacent the lower level drift, leaving a remaining zone of unfragmented formation within the retort site above the undercut. The zone of unfragmented formation is explosively expanded downwardly toward the undercut in lifts for forming a fragmented permeable mass of formation particles containing oil shale within the retort. At least a portion of the fragmented mass is withdrawn through the lower level drift before explosively expanding one or more of such lifts. Such withdrawal of formation particles can result in a region of relatively low permeability in the fragmented mass on a side of the fragmented mass opposite the lower level drift and a region of relatively higher permeability in the fragmented mass on a side of the fragmented mass adjacent the lower level drift. During retorting operations the fragmented mass is ignited at an upper portion of such a region of relatively lower permeability opposite the lower level drift for establishing a retorting zone within the fragmented mass. The retorting zone is advanced downwardly through the fragmented mass for producing liquid and gaseous products of retorting, and the liquid and gaseous products are withdrawn from a lower portion of the fragmented mass. By igniting the fragmented mass and introducing oxygen supplying gas into the upper portion of the lower permeability region of the fragmented mass, the amount of gas channeling through the higher permeability region can be minimized and more gas tends to flow through the low permeability region. There is a tendency to equalize the flow resistance of gas flow paths through the fragmented mass and a tendency to minimize loss of yield.

According to another embodiment, the zone of unfragmented formation can be explosively expanded in separate lifts, toward an undercut having a sloping bottom that slopes downwardly toward a lower level drift which opens through the side boundary of the retort. In one embodiment, each lift is explosively expanded toward a void space that is relatively larger adjacent the side of the retort above the low side of the undercut and relatively smaller adjacent the opposite side of the retort above the high side of the undercut. Due to blasting and drawing, the fragmented mass has a relatively lower permeability on the side above the high side of the undercut and a relatively higher permeability on the side above the low point, where particles are withdrawn from the fragmented mass through the lower level drift following explosive expansion of each lift. By introducing a principal portion of an oxygen-supplying gas to the upper portion of the low permeability side of the fragmented mass during retorting operations, gas flow through the fragmented mass can be equalized. In this embodiment the gas flow pattern through the fragmented mass can be diagonal from the upper low permeability region to the lower high permeability region.

DRAWINGS

These and other aspects of the invention will be more fully understood by referring to the following detailed description and accompanying drawings in which:

FIG. 1 is a fragmentary, semi-schematic vertical cross-section illustrating an in situ oil shale retort site in an initial stage of development according to principles of this invention; and FIG. 2 is a fragmentary, semi-schematic vertical cross-section similar to FIG. 1 and showing a completed in situ oil shale retort prepared according to principles of this invention.

DETAILED DESCRIPTION

Figure 1:
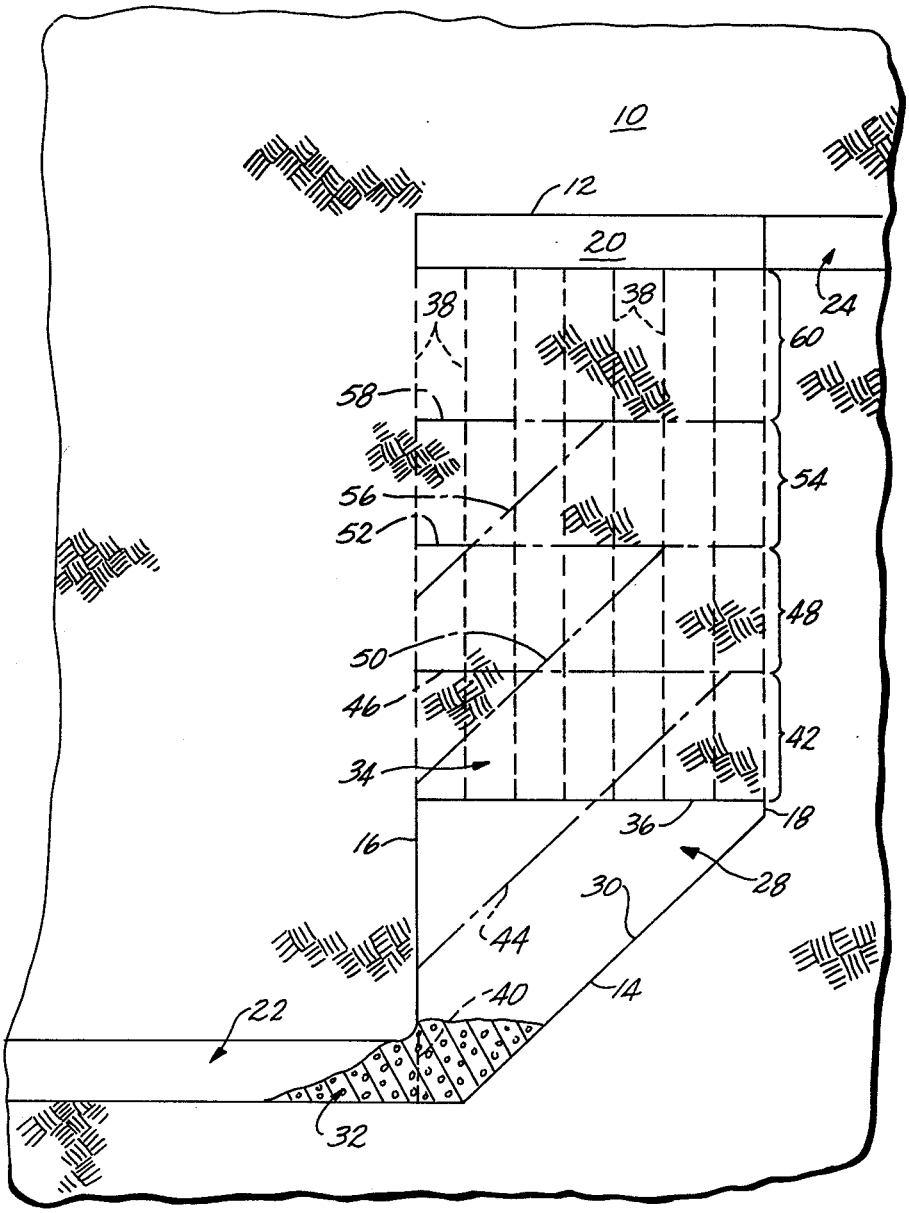

FIG. 1 is a semi-schematic, vertical cross-section illustrating an initial stage of development of an in situ oil shale retort being formed in accordance with principles of this invention. The in situ retort is formed in a retort site in a subterranean formation 10 containing oil shale.

Figure 2:
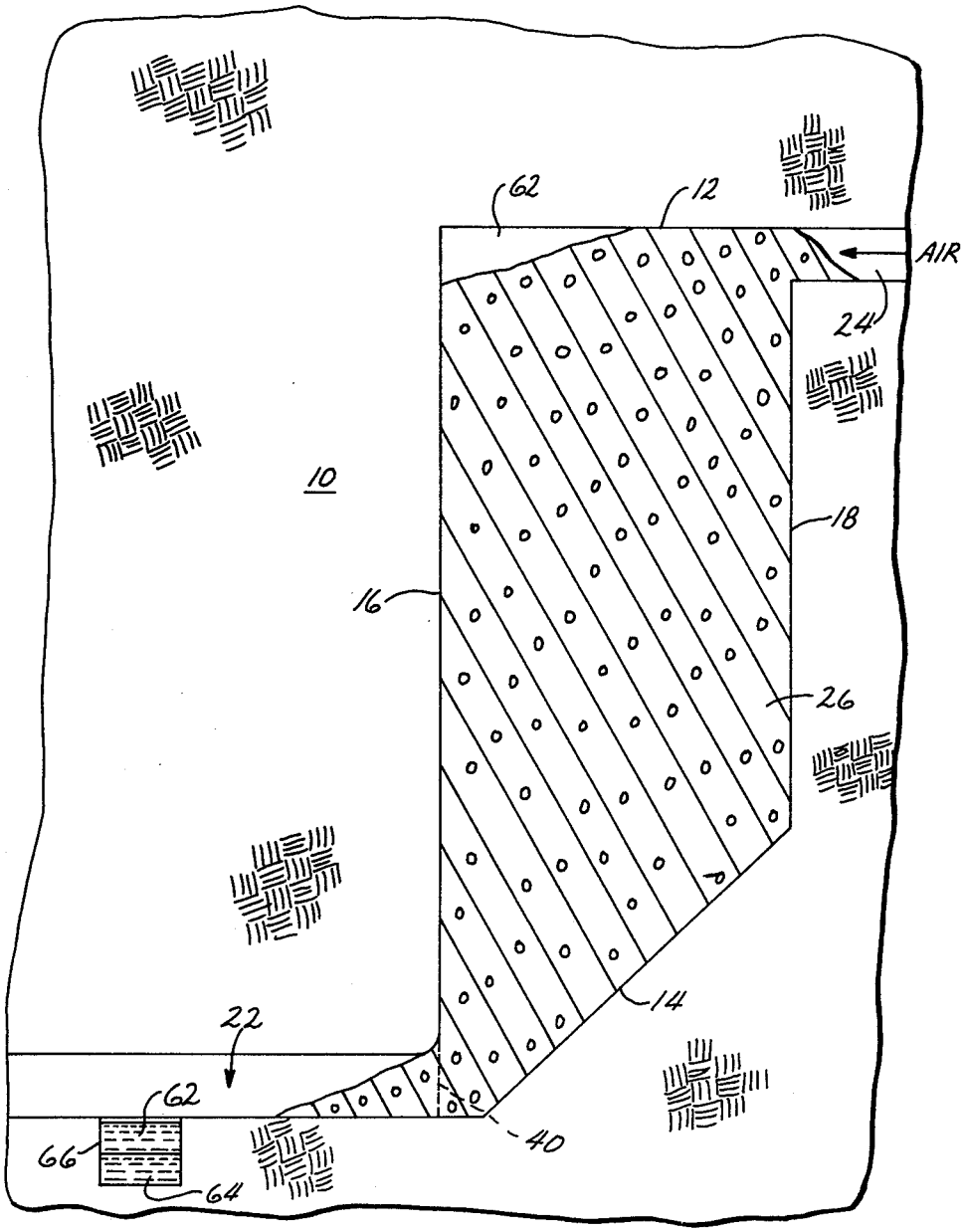

FIG. 2 illustrates the completed retort which, in the illustrated embodiment, is generally rectangular in horizontal cross-section, having a horizontal top boundary 12, a sloping lower boundary 14, and four vertically extending side boundaries which include a first side boundary 16 extending upwardly above a low point of the sloping bottom of the retort and a second side boundary 18 on the opposite side of the retort extending upwardly above the high side of the sloping bottom of the retort.

The in situ retort is formed by a two-level mining system which includes an upper level void 20 excavated generally horizontally at an upper level of the retort site, and at least one lower level drift 22 excavated generally horizontally across a lower level adjacent a lower portion of the retort site. Each such lower level access drift provides a separate entrance through the first side boundary 16 of the retort at the low side of the sloping bottom of the retort. In the description to follow, a single lower level access drift is described, although a plurality of horizontally spaced apart lower level access drifts can provide entrances to the bottom of the retort.

In the illustrated embodiment, the upper level void 20 provides an open base of operation above the retort site. The roof of the upper base of operation provides the upper boundary of the retort being formed. The base of operation is excavated by access provided by at least one upper level access drift 24 excavated on the same level as the floor of the upper base of operation. Pillars (not shown) of unfragmented formation can be left within the upper base of operation for providing temporary roof support above the base of operation. The horizontal cross-section of the base of operation is preferably similar to the horizontal cross-section of the retort being formed. The base of operation can provide effective access to substantially the entire horizontal cross-section of the retort being formed below it. The base of operation provides access for drilling and explosive loading for subsequently explosively expanding formation within the retort site for forming a fragmented permeable mass 26 of formation particles containing oil shale (see FIG. 2) within the upper, lower and side boundaries of the retort. As described in more detail below, the upper base of operation also provides a void space toward which formation can be explosively expanded for forming the fragmented mass; and the upper level drift or drifts 24 facilitate introduction of oxygen supplying gas, such as air, or other retort inlet mixture, into the top of the fragmented mass during subsequent retorting operations. The retort is described herein in terms of a single upper level access drift 24, although a plurality of horizontally spaced apart upper level access drifts can provide entrances to the upper level of the retort.

An undercut 28 is excavated from the access to the retort site provided by the lower level drift. The undercut is excavated with a sloping bottom 30 that slopes upwardly away from the lower level drift toward the second side boundary 18 on the side of the retort site opposite the lower level drift. The bottom of the undercut is generally flat and extends upwardly away from the lower level drift approximately at about the natural angle of repose of fragmented oil shale. The undercut is excavated so that the undercut has the same width as the retort being formed and so that the four vertical side walls of the undercut are aligned with the four vertical side boundaries of the rectangular retort site. Thus, the undercut has a horizontal cross-section similar to the horizontal cross-section of the retort being formed above the undercut.

The sloping bottom of the undercut can be formed by fan drilling angled blast holes from the region of the lower level access drift along the sloping bottom boundary of the retort. The undercut itself can be formed by excavating an initial void space (not shown) within the lower portion of the retort site, and explosively expanding formation within the boundaries of the undercut being formed toward the initial void space. Blasting holes for containing the explosive can be drilled downwardly from the upper level void 20 into formation within the boundaries of the undercut being formed. Fragmented formation particles produced during excavation of the undercut are removed through the lower level access drift. A fragmented permeable mass 32 of formation particles can be left in the lower portion of the undercut blocking the entrance from the lower level drift for attenuating air blast during explosive expansion of oil shale towards the undercut.

Excavation of the undercut 28 in the lower portion of the retort site leaves a zone 34 of unfragmented formation remaining within the boundaries of the retort site above the undercut. A generally horizontal first free face 36 of unfragmented formation extends across the bottom of the zone of unfragmented formation remaining within the retort site above the undercut. Owing to the sloping bottom of the undercut, the undercut has a relatively higher void portion adjacent the first side boundary 16 above the lower level drift and a relatively lower void portion above second side boundary 18 on the side of the retort opposite the lower level drift. The first horizontal free face 36 extends across substantially the entire horizontal cross-section of the retort site and the zone of formation above it is free of roof supporting pillars. Such pillars can be avoided despite the wide unsupported span since the excavation and retort forming techniques do not require that personnel enter the space beneath the unsupported span.

Following excavation of the undercut the remaining zone of unfragmented formation 34 is explosively expanded downwardly toward the undercut for forming the fragmented mass 26 within the boundaries of the retort.

Although various techniques can be used for explosively expanding the remaining zone 34 of unfragmented formation downwardly toward the undercut, in one embodiment the remaining zone 34 of unfragmented formation is explosively expanded downwardly in lifts. That is, the zone of formation is explosively expanded downwardly by explosively expanding separate horizontal layers of formation of generally uniform thickness in an upwardly progressing sequence. Explosive expansion of each lift progressively forms a separate new horizontal free face in such an upwardly progressing sequence, while progressively increasing the height of the fragmented mass remaining after progressive blasting of such lifts.

The zone 34 of unfragmented formation is explosively expanded by initially drilling a plurality of mutually spaced apart vertical blasting holes 38 downwardly from the upper base of operation 20 through the unfragmented formation within the retort site. These blasting holes can be blasting holes previously drilled to the sloping lower boundary of the retort site and used for explosive placement for forming the undercut 28. The blasting holes are preferably drilled on a uniform pattern in parallel rows with ther same spacing between blast holes in each row and between adjacent rows. In explosively expanding each lift, once the desired void volume is provided below each new free face, the bottoms of the blasting holes 38 are grouted or plugged by suitable means, and the lower portions of the blasting holes are stemmed. Preferably, vertical columnar charges of explosive are loaded into the portions of the blasting holes in the upper half of the lift being explosively expanded, and the remaining upper portions of the blasting holes, or portions of the blasting holes, above the lift being expanded are stemmed. Thus, the result is an array of explosive charges distributed across the horizontal cross-section of each lift. Explosive in the blasting holes is then detonated in a single round for explosively expanding formation within the lift toward the void space below it.

The fragmented mass can be formed by withdrawing a portion of the formation particles from the retort to provide additional void space before explosively expanding each new lift. Such particles are withdrawn from the retort site through a draw point opening 40 at the low point of the retort at the side entrance to the retort provided by the lower level drift 22. The steps of blasting downwardly in separate lifts and withdrawing formation particles before blasting each subsequent lift can create asymmetrical void fraction distribution in the fragmented mass as described in greater detail below.

The zone 34 of unfragmented formation is explosively expanded by initially explosively expanding a first lift 42 downwardly toward the first free face 36 above the undercut. After explosive expansion of the first lift, a sloping interim upper surface of the formation particles (represented by the phantom lines 44 in FIG. 1) lies more or less parallel to the sloping bottom of the retort. A portion of the fragmented mass, above the low side of the undercut, may contact the horizontal free face 46 remaining after blasting of the first lift 42. A portion of this fragmented mass can be withdrawn through the draw point 40 in the lower level drift to form additional void space over the fragmented mass left in the retort following explosive expansion of the first lift. The formation particles flow toward the draw point opening owing to the sloping bottom of the retort. The undercut is formed with a sloping bottom on an angle similar to the approximate natural angle of repose or angle of slide of fragmented formation particles containing oil shale. In the illustrated embodiment, the sloping bottom extends on an angle of approximately 38° to 48° relative to a horizontal plane through the bottom of the undercut. By forming the bottom of the undercut near the natural angle of slide of fragmented oil shale, and by forming the draw point opening of the lower level drift at the side of the retort at the low point of the sloping bottom of the retort, the top surface of the fragmented mass, following explosive expansion of each lift, remains roughly parallel to the sloping bottom of the undercut as the fragmented mass is being formed. As formation particles are withdrawn, particles near the upper surface of the fragmented mass above the lower level drift (from which material is drawn), will tend to loosen and slide more than particles along the floor. As a result, the surface of the rubble can be at a somewhat steeper angle above the lower drift then on the side of the retort opposite the lower drift. The rubble can be drawn down far enough so that the top surface of the rubble does not contact the new free face 46 and so that the top surface of the rubble seeks the average angle of repose by sliding or flowing during drawing. Preferably, several horizontally spaced apart draw point openings are provided at the low point of the sloping bottom of the retort to assist in maintaining a reasonably flat sloping top surface of the fragmented mass.

Explosive expansion of the first lift forms a second generally horizontal free face (represented by phantom line 46) below the zone of unfragmented formation remaining within the upper portion of the retort site. The sloping interim upper surface of the fragmented mass, following drawing, forms a generally wedge-shaped void space below the new free face. That is, the void space has a relatively larger height adjacent the first side 16 of the retort above the lower level drift and a relatively smaller height adjacent the opposite side 18 of the retort.

A second lift 48, i.e., a second layer of formation above the second free face 46, is explosively expanded downwardly toward the second free face for further enlarging the fragmented mass of particles in the retort. Following explosive expansion of the second lift, a larger fragmented mass of particles remains in the lower portion of the retort site with a sloping upper surface (represented by phantom line 50) which lies generally parallel to the previously sloping surface 44 and the sloping bottom 30 of the initial undercut 28. Such explosive expansion of the second lift forms a third generally horizontal free face (represented by phantom lines 52 ) above a sloping interim upper surface 50 of the fragmented mass. A sufficient amount of formation particles is then withdrawn from the fragmented mass through the draw point opening 40 to draw down the surface of the fragmented mass and provide a generally wedge-shaped void space having sufficient void volume for explosive expansion of the next lift.

A third lift 54 is then explosively expanded downwardly toward the resulting void space for further enlarging the fragmented mass of particles in the retort. Such expansion of the third lift forms a larger fragmented mass of particles with a sloping interim upper surface (represented by a phantom line at 56) generally parallel to the other sloping interim upper surfaces of the fragmented mass formed by explosively expanding the previous lifts. Explosive expansion of the third lift forms a further generally horizontal free face (represented by a phantom line at 58) below the zone of unfragmented formation remaining within the upper portion of the retort site. The fragmented mass then can be drawn down further prior to blasting the next lift.

The steps of alternately blasting downwardly in lifts and withdrawing formation particles through the lower level drift to provide a desired void volume for each successive lift can be repeated until an upper lift 60 is explosively expanded for forming an upper portion of the fragmented mass adjacent the upper boundary 12 of the retort. Preferably, the upper lift 60 is explosively expanded downwardly toward the wedge-shaped void space above the sloping interim upper surface of the fragmented mass below the free face 58 and also upwardly toward the void space within the upper level base of operation 20. A void space 62 is left above the fragmented mass in the completed retort, illustrated in FIG. 2, where the retort does not bulk full near the side edge of the fragmented mass above the lower level drift. The upper level access drift 24 provides access to the upper edge of the retort opposite the lower level drift.

As described above, following explosive expansion of each lift a mass of formation particles remains within the retort below each newly created free face. Prior to explosive expansion of each successive lift, formation particles are withdrawn through the draw point to drawn down the upper level of the fragmented mass remaining within the retort below the previously formed free face. A sufficient amount of formation particles is removed after blasting of each lift to provide a desired void volume within the void space toward which the next lift is explosively expanded. Preferably, a sufficient amount of formation particles is withdrawn from the draw point prior to expansion of each lift to provide a void space below each lift with a large enough void volume to allow essentially free expansion of oil shale toward the void space during explosive expansion of the lift. Such free expansion promotes high and reasonably uniform permeability of the fragmented mass resulting from explosive expansion of such a lift. A void volume of about 40% below each lift is sufficient to provide the desired expansion and the desired level of the resulting fragmented mass. Such free expansion is also referred to as expansion toward an essentially unlimited void volume. When formation is explosively expanded toward an unlimited void, the resulting fragmented mass of particles can reach a certain maximum void fraction due to reasonably free or unconstrained expansion. When explosively expanded toward a limited void, particles can interact with adjacent walls of unfragmented formation or other expanding formation and be restricted in total expansion, resulting in a void fraction less than possible by free expansion. If the total available void volume toward which formation is expanded is less than required for free expansion, clearly the voids distributed in the resulting fragmented mass can have no more total volume than the original void and the void fraction is less than possible due to free expansion. It is also found in some cases that the void volume in the fragmented mass is less than the available void due to the interactions during expansion and the fragmented mass does not bulk up enough to completely fill the available space. It is also found in some geometric configurations that interactions can limit the void fraction to less than possible by free expansion when the available void volume would appear large enough to accommodate free expansion. These can also be considered to be limited voids. For example, when the void volume toward which formation is explosively expanded is less than about 40% of the total volume of the void plus the volume of the zone of formation being explosively expanded, then such explosive expansion can be toward a limited void volume.

Prior to explosive expansion of the upper lift 60, care is taken to withdraw only a sufficient amount of formation particles from the lower draw point to ensure that the void left above the fragmented mass following explosive expansion of the upper lift is either minimal, or the retort is bulked essentially full. In this instance, a total void space having a void volume of about 25%, based on the total volume of the upper void space plus the upper left and the upper void 20, can provide the desired bulking full. The fragmented mass is bulked full at the upper entry side of the retort (at the upper level drift 24) to facilitate start up of retorting operations.

Techniques for alternately blasting downwardly in lifts and removing a portion of the formation particles remaining in the retort following expansion of each lift are described in greater detail in U.S. patent application Ser. No. 067,921, filed Aug. 20, 1979, entitled "TWO-LEVEL MINING SYSTEM FOR IN SITU OIL SHALE RETORTS", now U.S. Pat. No. 4,349,227 which is incorporated herein by this reference.

In the embodiment described above, in which fragmented formation particles are withdrawn from one or more draw points at the low side of the sloping bottom of the retort being formed, an asymmetrical distribution of permeability in the fragmented mass can be created due to the withdrawal of material from one side of the fragmented mass. That is, the drawing of formation particles from near the side boundary at the bottom of the retort can form a "draw cone" which extends upwardly and laterally from the entrance of the lower level drift draw point. The draw cone is formed as a result of formation particles that move downwardly in response to withdrawal of material from below. The void fraction in the draw cone is higher than in formation particles adjacent to the draw cone due to a loosening effect as material is withdrawn.

Further, as formation particles move laterally toward the side boundary to replace material in the draw cone, some particle size segregation can be created in the fragmented mass. Near the upper surface of the fragmented mass, relatively larger formation particles tend to move preferentially toward the low side of the fragmented mass, while relatively finer particles remain near the high side. This particle size segregation can also result in relatively higher permeability near the lower side of the fragmented mass.

Thus, when the several lifts are explosively expanded into the retort, and particles are withdrawn from along one side boundary before blasting each new lift, the resulting fragmented mass can have a relatively lower permeability along the opposite or second side boundary 18 of the fragmented mass. The steps of blasting each lift toward a wedge-shaped void space also can preferentially create higher permeability in the fragmented mass along the first side boundary (where the wider portion of each wedge-shaped void is located) and a lower permeability along the opposite side.

Alternatively, the fragmented mass in the retort can be formed by a partially similar technique that can result in a smaller dissimilarity in permeability between the opposite sides of the fragmented mass. In such an embodiment the geometry of the retort is essentially the same as hereinabove described and the initial steps in forming the fragmented mass are similiar. In this embodiment the undercut 28 is excavated with a sloping bottom 30 and at least a first lift 42 is explosively expanded into the undercut as hereinabove described. Instead of leaving a principal portion of the fragmented mass from such a lift in the retort site, most of the formation particles from the lift are withdrawn to form a large undercut. The undercut is enlarged by explosively expanding one or more such lifts and withdrawing formation particles until the void space in the undercut and the overlying void 20 is sufficiently large to receive all of the remaining unfragmented formation. The remaining portion of the zone of unfragmented formation is then explosively expanded as above described in one or more lifts without withdrawing additional fragmented formation through the lower level drift. This avoids the high permeability region introduced in a draw cone as formation particles are withdrawn and tends to minimize size segregation as well.

The higher permeabiity region can be ameliorated somewhat by the time delay sequence employed during explosive expansion of such a lift. When such a lift is expanded it can be desirable to detonate explosive charges in a time delay sequence rather than detonating all of the charges simultaneously. For example, a time delay between at least some of the charges can be about one millisecond per foot of spacing between such charges. It appears that formation is preferentially thrown towards the locus of the first charges detonated. For example, when detonation is initiated first near the center of an array of explosive charges with initiation of detonation of successive charges progressing radially outwardly, a mound of fragmented formation higher in the center can be produced. Thus, it is desirable to initiate detonation of the array of explosive charges in such a lift in a row of charges near the side boundary 16 of the retort above the lower level drift 22 and progress laterally across the array from the first row. Preferably, the first row is spaced apart from the side boundary to minimize edge effects. This tends to preferentially throw fragmented formation towards the lower side of the wedge-shaped void space.

A technique for forming a fragmented mass that results in a permeability gradient in the fragmented mass could lead to gas flow channeling and significant loss of yield from the retort. Such loss of yield can be minimized by compensating the start up for the permeability gradient in the fragmented mass. During retorting operations the fragmented mass is ignited near the top side boundary of the fragmented mass opposite the lower level drift for establishing a combustion zone in an upper portion of the fragmented mass. After ignition, air or other suitable retort inlet mixture is introduced through the one or more upper level drifts 24 that lead into the upper side boundary of the fragmented mass. In the illustrated embodiment, the fragmented mass is bulked full at the upper entry and the air or other retort inlet mixture is introduced into the fragmented mass at the upper entry to the exclusion of air or other retort inlet mixture being introduced elsewhere along the top of the fragmented mass. Stated another way, a principal portion of the air or other retort inlet mixture is introduced into the upper portion of the relatively lower permeability region of the fragmented mass, on the side of the fragmented mass opposite an outlet at the low side of the bottom of the fragmented mass. Such air or other retort inlet mixture sustains the combustion zone established in the fragmented mass and causes it to advance downwardly through the fragmented mass. Off gas is withdrawn through the lower level drift. Thus, the gas flow through the fragmented mass is generally diagonally from the upper edge of the side boundary opposite the lower draw point toward the lower edge of the other side boundary near the lower draw point.

By introducing air or other retort inlet mixture primarily in the upper portion of the low permeability region of the fragmented mass, the quantity of gas channeling through the high permeability region of the fragmented mass can be minimized, and more gas tends to flow through the low permeability region where the retort inlet mixture is constantly being introduced. The result is a tendency to equalize the flow resistance of gas flow paths through the fragmented mass, with a tendency to minimize loss of yield.

During retorting operations, combustion gas produced in the combustion zone passes downwardly through the fragmented mass to establish a retorting zone on the advancing side of the combustion zone, where kerogen in the oil shale is retorted to produce liquid and gaseous products of retorting. The liquid products including shale oil 62 and water 64, and an off gas containing gaseous products both pass to the bottom of the fragmented mass and pass into the lower level drift 22. The liquid products and the off gas are separately withdrawn from the lower level drift. In the embodiment of FIG. 2, off gas is withdrawn from the lower level drift by a blower connected to a gas withdrawal line sealed through a bulkhead in a principal production level drift (not shown) that communicates with the lower level drift. The shale oil which collects in a sump 66 in the lower level drift is withdrawn by an oil withdrawal line connected to an oil pump. The water 64 is withdrawn from the sump through a separate water line connected to a water pump.

An advantage of the present invention is that a two-level mining system can be used for forming the fragmented mass, in which the lower level drift can communicate with the sloping lower portions of the fragmented mass of a pair of side-by-side retorts, and in which an upper air level drift can communicate with the upper side boundaries of a pair of retorts, one of which is in communication with one lower level drift and the other of which is connected to a second lower level drift. Such a two-level mining system can provide significant savings in mining costs when compared with a system having multiple intermediate retort level voids and corresponding access drifts, for example.

What is claimed is:

1. A method for recovering liquid and gaseous products from an in situ oil shale retort formed in a retort site in a subterranean formation containing oil shale, such an in situ oil shale retort containing a fragmented permeable mass of formation particles containing oil shale formed within upper, lower, and generally vertical side boundaries of the retort site, the method comprising the steps of:

excavating a lower level drift in such formation adjacent the lower boundary of the retort site;

excavating an undercut in a lower portion of the retort site adjacent the lower level drift, leaving a zone of unfragmented formation remaining within the retort site above the undercut, the lower level drift opening into the undercut near a side boundary of the retort site;

explosively expanding the zone of unfragmented formation downwardly toward the undercut in lifts in a plurality of sequential horizontal layers of formation from the bottom of such zone of unfragmented formation upwardly toward the upper boundary of the retort site for forming a fragmented permeable mass of formation particles containing oil shale within the retort site;

withdrawing at least a portion of the fragmented particles from such a lift through the lower level drift before explosive expansion of at least one of such lifts, such withdrawal of formation particles producing a region of relatively higher permeability in the fragmented mass on a side thereof adjacent the lower level drift, and a region of relatively lower permeability in the fragmented mass on a side thereof opposite the lower level drift;

igniting the fragmented mass at an upper portion of the region of relatively lower permeability opposite the lower level drift for establishing a retorting zone within the fragmented mass;

introducing a retort inlet mixture to an upper portion of the region of relatively lower permeability for advancing the retorting zone downwardly through the fragmented mass for producing liquid and gaseous products of retorting; and withdrawing the liquid and gaseous products of retorting from the lower portion of the fragmented mass through the lower level drift.

2. The method according to claim 1 including introducing oxygen supplying gas into the upper portion of the region of lower permeability from an upper level drift that opens into an upper edge of the fragmented mass on a side of the fragmented mass opposite the side where the lower level drift opens into the fragmented mass.

3. The method according to claim 1 including forming the undercut with a bottom that slopes upwardly away from the lower level drift toward the opposite side of the retort.

4. The method according to claim 3 including forming the bottom of the undercut generally at the natural angle of slide of formation particles containing oil shale.

5. The method according to claim 1 including explosively expanding such a lift toward at least one void space that is relatively narrower on the side of the retort opposite the lower level drift and relatively wider on the side of the retort adjacent the lower level drift.

6. A method for recovering liquid and gaseous products from an in situ oil shale retort formed in a retort site in a subterranean formation containing oil shale, such an in situ oil shale retort containing a fragmented permeable mass of formation particles containing oil shale formed within upper, lower and generally vertical side boundaries of the retort site, the method comprising the steps of:

excavating at least one void within the retort site, leaving at least one zone of unfragmented formation remaining within the retort site adjacent such a void;

explosively expanding such a zone of unfragmented formation toward such a void for forming a fragmented permeable mass of formation particles containing oil shale within the boundaries of the retort site, such explosive expansion being in a plurality of sequential explosive expansion steps;

withdrawing at least a portion of the formation particles from one of such explosive expansion steps prior to another of such explosive expansion steps, such formation particles being withdrawn through at least one draw point at a lower portion of the fragmented mass near a side boundary of the fragmented mass, such withdrawal of formation particles from the fragmented mass producing a region of relatively higher permeability in the fragmented mass extending along a side thereof adjacent such a draw point, and a region of relatively lower permeability in the fragmented mass extending along a side thereof opposite such a draw point; an inlet to the fragmented mass being provided adjacent an upper portion of the region of relatively higher permeability and an outlet from the fragmented mass being provided adjacent such a draw point; and establishing a retorting zone in the fragmented mass by introducing an oxygen supplying gas into the fragmented mass at the upper portion of the region of relatively lower permeability opposite such a draw point for causing such gas to flow diagonally through the fragmented mass from the inlet toward the outlet for advancing the retorting gas zone through the fragmented mass for producing liquid and gaseous products of retorting in the fragmented mass.

7. The method according to claim 6 including explosively expanding such a zone of unfragmented formation toward a generally wedge-shaped void space that is relatively narrower adjacent the side of the fragmented mass opposite the draw point and relatively wider at the side of the retort adjacent the draw point.

8. The method according to claim 6 including initiating detonation of explosive closer to the draw point than the side of the retort opposite the draw point.

9. A method for recovering liquid and gaseous products from an in situ oil shale retort formed in a retort site in a subterranean formation containing oil shale, such an in situ oil shale retort containing a fragmented permeable mass of formation particles containing oil shale formed within upper, lower and generally vertical side boundaries of the retort site, the method comprising the steps of:

explosively expanding a plurality of zones of unfragmented formation within the retort site in a time delay sequence for progressively forming a fragmented permeable mass of formation particles containing oil shale in an upwardly progressing sequence within the retort site;

withdrawing formation particles from the fragmented mass prior to explosively expanding each of such zones of unfragmented formation, such formation particles being withdrawn from an outlet at a lower side boundary of the fragmented mass, causing a change in the void fraction distribution in the fragmented mass such that a region of relatively higher permeability is formed along a side of the fragmented mass adjacent the side from which such formation particles are withdrawn, and a region of relatively lower permeability is formed along a side of the fragmented mass opposite the side from which such formation particles are withdrawn; and introducing oxygen supplying gas into an inlet into an upper portion of such a region of relatively lower permeability for establishing a retorting zone in the fragmented mass for causing gas flow diagonally through the fragmented mass from the inlet toward the outlet for producing liquid and gaseous products of retorting in the fragmented mass.

10. A method according to claim 9 including explosively expanding such a zone of unfragmented formation toward a void space that is relatively narrower on the side of the retort opposite the side from which such formation particles are withdrawn and relatively wider on the side of the retort adjacent the side from which such formation particles are withdrawn.

11. The method according to claim 9 including explosively expanding each of such zones of unfragmented formation toward a generally wedge-shaped void space.

12. The method according to claim 9 including explosively expanding the last zone of unfragmented formation in said sequence downwardly toward a generally wedge-shaped void and upwardly toward a void space above the last zone.

13. The method according to claim 9 including initiating detonation of explosive in such a zone of unfragmented formation relatively closer to the side of the retort from which particles are withdrawn than the side of the retort opposite from where such particles are withdrawn.

14. A method of recovering liquid and gaseous products from an in situ oil shale retort in a retort site in a subterranean formation containing oil shale, such an in situ oil shale retort containing a fragmented permeable mass of formation particles containing oil shale formed within upper, lower and generally vertical side boundaries of the retort site, the method comprising the steps of:

excavating an undercut extending across the lower portion of the retort site, leaving a zone of unfragmented formation remaining within the retort site above the undercut, the undercut having a sloping bottom forming a larger portion of the undercut adjacent one side boundary of the retort site and a smaller portion of the undercut adjacent an opposite side boundary of the retort site;

explosively expanding the remaining zone of unfragmented formation downwardly toward the undercut in lifts each of generally uniform thickness in an upwardly progressing time delay sequence from the bottom of such a zone of unfragmented formation upwardly toward the upper boundary of the retort site for progressively forming a fragmented permeable mass of formation particles containing oil shale within the retort site, each lift being explosively expanded toward a void space having a sloping bottom wherein such a void space has a relatively smaller portion on the same side of the retort site as the narrower portion of the undercut and a relatively larger portion on the same side of the retort site as the larger portion of the undercut, such explosive expansion producing a region of relatively lower permeability extending along the same side of the fragmented mass previously occupied by such a relatively smaller portion of such a void space and a region of relatively higher permeability along the same side of the fragmented mass previously occupied by such a relatively larger portion of such a void space; and establishing a retorting zone in the fragmented mass by introducing oxygen-supplying gas near an upper edge of the fragmented mass above the upper portion of such a region of lower permeability and withdrawing off gas from an opposite lower corner of the fragmented mass below such a region of higher permeability for causing gas to flow generally diagonally through the fragmented mass for producing liquid and gaseous products of retorting.

15. The method according to claim 14 including introducing the oxygen-supplying gas into the fragmented mass along the upper lower permeability side of the fragmented mass to the exclusion of gas being introduced into the fragmented mass elsewhere along the top of the fragmented mass.

16. The method according to claim 4 including removing at least a portion of the formation particles from the fragmented mass following explosive expansion of each lift for providing a void space toward which each successive lift is explosively expanded.

17. The method according to claim 16 including removing the particles from the fragmented mass through an outlet at a lower portion of the fragmented mass adjacent the side of the retort having the relatively larger portion of such a void space.

18. A method for recovering liquid and gaseous products from an in situ oil shale retort formed in a retort site in a subterranean formation containing oil shale, such an in situ oil shale retort containing a fragmented permeable mass of formation particles containing oil shale, the method comprising the the steps of:

excavating an undercut in a lower portion of the retort site, leaving a zone of unfragmented formation remaining within the retort site above the undercut, the undercut having a sloping bottom forming a larger portion of the undercut adjacent one side boundary of the retort site and a smaller portion of the undercut adjacent an opposite side boundary of the retort site;

explosively expanding the remaining zone of unfragmented formation downwardly toward the undercut in lifts each of generally uniform thickness from the bottom of such a zone of unfragmented formation upwardly toward the upper boundary of the retort site for forming a fragmented permeable mass of formation particles containing oil shale within the retort site, each lift being explosively expanded toward a void space with a sloping bottom wherein such a void space has a relatively larger portion on the same side of the retort as the larger portion of the undercut and a relatively smaller portion on the same side of the retort as the narrower portion of the undercut, such explosive expansion forming a fragmented mass having a region of relatively higher permeability extending along the side of the fragmented mass previously occupied by such a larger portion of such void spaces and a region of relatively narrower permeability extending along the side of the fragmented mass previously occupied by such a smaller portion of such void spaces; and establishing a retorting zone in the fragmented mass by introducing an oxygen-supplying gas into an inlet of the fragmented mass at an upper edge of the fragmented mass above the upper portion of such a region of lower permeability and withdrawing off gas from an outlet at a lower edge of the fragmented mass below the region of relatively higher permeability for causing gas to flow diagonally through the fragmented mass from the inlet toward the outlet for producing liquid and gaseous products of retorting in the fragmented mass.

19. The method according to claim 18 including withdrawing formation particles between lifts from the fragmented mass through an outlet at a lower portion of the retort adjacent the side of the retort having a relatively wider portion of such a void space.

20. A method according to claim 18 including introducing the oxygen-supplying gas into the fragmented mass along the upper low permeability side of the fragmented mass to the exclusion of gas being introduced into the fragmented mass elsewhere along the top of the fragmented mass.

21. A method for recovering liquid and gaseous products from an in situ oil shale retort formed in a retort site in a subterranean formation containing oil shale, such an in situ oil shale retort containing a fragmented permeable mass of formation particles containing oil shale, the method comprising the steps of:

excavating a lower level drift in such formation adjacent the lower boundary of the retort site;

excavating an undercut in a lower portion of the retort site, leaving a zone of unfragmented formation within the retort site above the undercut, the undercut having a sloping bottom forming a relatively larger portion of the undercut on a side of the retort adjacent the lower level drift, and a relatively smaller portion of the undercut on the side of the retort opposite the lower level drift;

explosively expanding the zone of unfragmented formation downwardly toward the undercut in lifts from the bottom of the zone of unfragmented formation upwardly toward the upper boundary of the retort site for forming a fragmented permeable mass of formation particles containing oil shale within the retort site, each such lift being explosively expanded toward a corresponding void space having a relatively larger portion of the void space on the same side of the fragmented mass as the lower level drift and a relatively smaller portion of the void space on the side of the fragmented mass opposite the lower level drift;

withdrawing formation particles from the fragmented mass through the lower level drift before explosively expanding each of such lifts, such withdrawal of formation particles from the fragmented mass producing a region of relatively lower permeability in the fragmented mass on a side thereof opposite the lower level drift and a region of relatively higher permeability in the fragmented mass on a side thereof adjacent the lower level drift; and igniting the fragmented mass at an upper portion of such a region of lower permeability opposite the lower level drift for establishing a retorting zone in the fragmented mass.

22. The method according to claim 19 including introducing oxygen supply gas principally near the upper portion of the fragmented mass where the fragmented mass is ignited and withdrawing off gas from an opposite lower portion of the fragmented mass for causing gas to flow generally diagonally through the fragmented mass.

23. The method according to claim 21 including forming the sloping bottom of the undercut at approximately the natural angle of slide of formation particles containing oil shale.

24. A method for recovering liquid and gaseous products from an in situ oil shale retort in a subterranean formation containing oil shale, such an in situ oil shale retort containing a fragmented permeable mass of formation particles containing oil shale, the method comprising the steps of:

excavating a lower level drift in such formation adjacent the lower boundary of the retort site;

excavating an undercut in a lower portion of the retort site adjacent the lower level drift, leaving a zone of unfragmented formation remaining within the retort site above the undercut, the undercut having a sloping bottom forming a relatively larger portion of the undercut adjacent one side boundary of the retort being formed and a relatively smaller portion of the undercut adjacent an opposite side boundary of the retort site, the lower level drift opening into the larger portion of the undercut near a lower side boundary of the retort site;

explosively expanding the remaining zone of unfragmented formation downwardly toward the undercut in lifts from the bottom of the zone of unfragmented formation upwardly toward the upper boundary of the retort site for forming a fragmented permeable mass of formation particles containing oil shale within the retort site;

withdrawing at least a portion of the fragmented mass of particles through the lower level drift before explosive expansion of each of such lifts and forming a region of relatively higher permeability in the fragmented mass on a side thereof adjacent the lower level drift and a region of relatively lower permeability in the fragmented mass on a side thereof opposite the lower level drift, the sloping bottom of such undercut having a slope approximately on the natural angle of slide of formation particles containing oil shale; and introducing oxygen supplying gas through an inlet adjacent an upper portion of such a region of relatively lower permeability for establishing a retorting zone in the fragmented mass and withdrawing off gas from an outlet near a lower portion of the region of higher permeability for causing gas to flow diagonally through the fragmented mass from the inlet toward the outlet for advancing the retorting zone through the fragmented mass for producing liquid and gaseous products of retorting in the fragmented mass.

25. A method for recovering liquid and gaseous products from an in situ oil shale retort formed in a retort site in a subterranean formation containing oil shale, such an in situ oil shale retort containing a fragmented permeable mass of formation particles containing oil shale, the method comprising the steps of:

excavating an undercut in a lower potion of the retort site, the undercut having a sloping bottom that slopes downwardly toward a lower side boundary of the undercut, leaving a zone of unfragmented formation within the retort site above the undercut;

providing a draw point opening at the lower side boundary of the undercut;

explosively expanding the zone of unfragmented formation above the undercut downwardly toward the undercut in a plurality of generally horizontally extending layers from the bottom of such a zone of unfragmented formation upwardly toward the upper boundary of the retort site in an upwardly progressing sequence within the retort site, such explosive expansion being carried out by repeating the steps of:

(1) placing explosive in each layer;

(2) detonating such explosive for explosively expanding such a layer to form at least a portion of the fragmented mass below a zone of unfragmented formation remaining within the retort site, and (3) withdrawing a portion of the fragmented mass from each layer through said draw point opening for providing a void space between the fragmented mass being formed and such a remaining zone of unfragmented formation prior to explosively expanding the next lift, the fragmented mass having a region of relatively lower permeability expanding along the side of the fragmented mass opposite said draw point opening and a region of generally higher permeability expanding along a side of the fragmented mass adjacent said draw point opening; and introducing oxygen supplying gas through an inlet in an upper portion of such a region relatively lower permeability for establishing a retorting zone in the fragmented mass and withdrawing off gas from a lower portion of the region of relatively higher permeability at the draw point for causing gas to flow diagonally through the fragmented mass from the inlet toward the draw point for advancing the retorting zone through the fragmented mass for producing liquid and gaseous products of retorting in the fragmented mass.

26. The method according to claim 25 in which the void volume of such a void space is about equal to the free expansion value of formation during expansion of the next layer.

27. A method for forming an in situ oil shale retort in a retort site in a subterranean formation containing oil shale, such an in situ oil shale retort containing a fragmented permeable mass of formation particles containing oil shale, the method comprising the steps of:

excavating an undercut in a lower portion of the retort site, leaving a zone of unfragmented formation remaining within the retort site above the undercut, the undercut having a sloping bottom forming a wider portion of the undercut adjacent one side boundary of the retort being formed and a narrower portion of the undercut adjacent an opposite side boundary of the retort site, the remaining zone of unfragmented formation having a horizontally extending free face overlying the undercut;

explosively expanding the remaining zone of unfragmented formation downwardly toward the undercut in a sequence of generally horizontally extending layers from the bottom of the zone of unfragmented formation upwardly toward the upper boundary of the retort site for forming a fragmented permeable mass of formation partaicles containing oil shale within the retort site; and withdrawing at least a portion of the fragmented formation particles from the fragmented mass following explosive expansion of such layers, such withdrawal of formation particles producing a region of relatively higher permeability in the fragmented mass on a side thereof adjacent the wider portion of the undercut and a region of relatively lower permeability in the fragmented mass on a side thereof adjacent the narrower portion of the undercut.

28. The method according to claim 27 including explosively expanding each layer toward a void space with a sloping bottom wherein such a void space has a relatively wider portion of the undercut and a relatively narrower portion on the same side of the retort as the narrower portion of the undercut.

29. The method according to claim 27 including withdrawing sufficient fragmented formation particles, after each layer is explosively expanded equal to the free expansion valve for the next layer.

30. The method according to claim 27 including explosively expanding the last of such layers downwardly toward a void space above the fragmented mass being formed and upwardly toward an overhead void space.

31. The method according to claim 27 including explosively expanding the remaining zone of unfragmented formation downwardly such that the fragmented mass being formed has a top surface at an angle generally equal to the natural angle of slide of fragmented oil shale particles.

32. The method according to claim 30 including explosively expanding the remaining zone of unfragmented formation such that the upper surface of the fragmented mass being formed following expansion of each layer is generally at the same angle as the sloping bottom of the undercut.

33. The method according to claim 32 in which the sloping bottom of the undercut is generally at the natural angle of slide of fragmented oil shale particles.

34. A method for recovering liquid and gaseous products from an in situ oil shale retort formed in a retort site in a subterranean formation containing oil shale, such an in situ oil shale retort containing a fragmented permeable mass of formation particles containing oil shale, the method comprising the steps of:

excavating an undercut in a lower portion of the retort site, leaving a zone of unfragmented formation remaining within the retort site above the undercut, the undercut having a sloping bottom forming a larger portion of the undercut adjacent one side boundary of the retort site and a smaller portion of the undercut adjacent an opposite side boundary of the retort site;

explosively expanding the remaining zone of unfragmented formation downwardly toward the undercut in lifts from the bottom of such a zone of unfragmented formation upwardly toward the upper boundary of the retort site for forming a fragmented permeable mass of formation particles containing oil shale within the retort site, each lift being explosively expanded downwardly toward a void space with a sloping bottom wherein such a void space is left between the top of the fragmented mass being formed and the bottom of the next lift to be explosively expanded and wherein such a void space has a relatively larger portion on the same side of the retort as the larger portion of the undercut and a relatively smaller portion on the same side of the retort as the narrower portion of the undercut, such explosive expansion forming a fragmented mass having a region of relatively higher permeability extending along the side of the fragmented mass previously occupied by such a larger portion of such void spaces and a region of relatively narrower permeability extending along the side of the fragmented mass previously occupied by such a smaller portion of such void spaces; and establishing a retorting zone in the fragmented mass by introducing an oxygen-supplying gas into an inlet of the fragmented mass at the upper corner of the fragmented mass above such a region of lower permeability and withdrawing off gas from an outlet at a lower corner of the fragmented mass below the region of relatively higher permeability for causing gas to flow generally diagonally through the fragmented mass from the inlet toward the outlet for producing liquid and gaseous products of retorting in the fragmented mass.

35. The method according to claim 34 including introducing the oxygen-supplying gas into the fragmented mass along the upper low permeability side of the fragmented mass to the exclusion of air being introduced into the fragmented mass elsewhere along the top of the fragmented mass.

* * * * *